US009946186B2

(12) United States Patent
Miyamoto

(10) Patent No.: US 9,946,186 B2
(45) Date of Patent: Apr. 17, 2018

(54) IMAGE FORMING APPARATUS INCLUDING UNIT ATTACHABLE TO AND DETACHABLE FROM APPARATUS MAIN BODY, CONDUCTIVE MEMBER DISPOSED IN UNIT, CONTACT SPRING DISPOSED IN APPARATUS MAIN BODY AND CONFIGURED TO COME IN ELECTRICALLY CONDUCTIVE CONTACT WITH CONDUCTIVE MEMBER, AND HOLLOW CYLINDER DISPOSED IN APPARATUS MAIN BODY AND RETAINING CONTACT SPRING

(71) Applicant: KYOCERA Document Solutions Inc., Osaka (JP)

(72) Inventor: Takuya Miyamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/442,758

(22) Filed: Feb. 27, 2017

(65) Prior Publication Data

US 2017/0261880 A1 Sep. 14, 2017

(30) Foreign Application Priority Data

Mar. 11, 2016 (JP) ..... 2016-047980

(51) Int. Cl.

| | |
|---|---|
| ***G03G 15/00*** | (2006.01) |
| ***G03G 15/02*** | (2006.01) |
| ***G03G 21/16*** | (2006.01) |
| ***G03G 21/18*** | (2006.01) |

(52) U.S. Cl.

CPC ..... *G03G 15/0283* (2013.01); *G03G 15/0233* (2013.01); *G03G 21/1652* (2013.01); *G03G 21/1867* (2013.01); *G03G 2215/025* (2013.01)

(58) Field of Classification Search

CPC ..... G03G 15/0283; G03G 15/80; G03G 21/1652; G03G 21/1867

USPC ..... 399/90

See application file for complete search history.

(56) References Cited

U.S. PATENT DOCUMENTS

| | | | | |
|---|---|---|---|---|
| 6,185,390 | B1 * | 2/2001 | Higeta et al. | G03G 21/1867 399/90 |
| 8,588,641 | B2 * | 11/2013 | Mimbu et al. | G03G 15/1645 399/90 |
| 9,046,806 | B2 * | 6/2015 | Souda | G03G 21/1652 399/90 |

FOREIGN PATENT DOCUMENTS

JP H09-319239 A 12/1997

* cited by examiner

*Primary Examiner* — William J Royer

(74) *Attorney, Agent, or Firm* — Studebaker & Brackett PC

(57) ABSTRACT

An image forming apparatus includes an apparatus main body, a conductive member, a contact spring, a hollow cylinder, and a drum unit attachable to and detachable from the apparatus main body. The conductive member is disposed in the drum unit. The contact spring is disposed in the apparatus main body and comes in electrically conductive contact with the conductive member. The hollow cylinder is disposed in the apparatus main body. The contact spring has a contact part and a helical spring part. The contact part is provided on the helical spring part. The contact part is retractable in and out of the hollow cylinder. The helical spring part is contained in the hollow cylinder and urges the contact part in a direction for causing the contact part to protrude from the hollow cylinder. The contact part has a longitudinal shape elongated along an axis of the helical spring part.

13 Claims, 10 Drawing Sheets

IMAGE FORMING APPARATUS INCLUDING UNIT ATTACHABLE TO AND DETACHABLE FROM APPARATUS MAIN BODY, CONDUCTIVE MEMBER DISPOSED IN UNIT, CONTACT SPRING DISPOSED IN APPARATUS MAIN BODY AND CONFIGURED TO COME IN ELECTRICALLY CONDUCTIVE CONTACT WITH CONDUCTIVE MEMBER, AND HOLLOW CYLINDER DISPOSED IN APPARATUS MAIN BODY AND RETAINING CONTACT SPRING

INCORPORATION BY REFERENCE

The present application claims priority under 35 U.S.C. § 119 to Japanese Patent Application No. 2016-047980, filed on Mar. 11, 2016. The contents of this application are incorporated herein by reference in their entirety.

BACKGROUND

The present disclosure relates to an image forming apparatus.

An image forming apparatus includes an apparatus main body and a unit. The unit is attachable to and detachable from the apparatus main body. The apparatus main body includes a contact spring and a hollow cylinder. The contact spring comes in electrically conductive contact with a conductive member of the unit. The contact spring has a contact part and a helical spring part. The contact part has a circular ring shape and is formed by raising a portion of the helical spring part at one end. The helical spring part is disposed in the hollow cylinder and urges the contact part in a direction for causing the contact part to protrude from the hollow cylinder.

As the unit is attached to the apparatus main body, the conductive member comes in electrically conductive contact with the contact part. When a distance between the conductive member and the contact part in a direction parallel with an axis of the helical spring part is smaller than a specific value, the conductive member that has come in contact with the contact part pushes the contact part into the hollow cylinder. The helical spring part is then compressed by a distance corresponding to a distance by which the contact part is pushed into the hollow cylinder. As a result, the conductive member can come in electrically conductive contact with the contact part even if the distance between the conductive member and the contact part in the direction parallel with the axis of the helical spring part changes every time the unit is attached to the apparatus main body.

Where the distance between the conductive member and the contact part in the direction parallel with the axis of the helical spring part is likely to be large, a stroke of the helical spring part is increased. The stroke of the helical spring part refers to a length by which the helical spring part is compressed when the contact part is pushed into the hollow cylinder.

SUMMARY

An image forming apparatus according to the present disclosure includes an apparatus main body, a unit, a conductive member, a contact spring, and a hollow cylinder. The unit is attachable to and detachable from the apparatus main body. The conductive member is disposed in the unit. The contact spring is disposed in the apparatus main body and comes in electrically conductive contact with the conductive member. The hollow cylinder is disposed in the apparatus main body and retains the contact spring. The apparatus main body forms an image on a recording medium in conjunction with the unit. The contact spring has a helical spring part and a contact part. The contact part is provided on one end of the helical spring part. The contact part protrudes from one end opening of the hollow cylinder, and is retractable in and out of the hollow cylinder through the one end opening. The helical spring part is contained in the hollow cylinder and urges the contact part in a direction for causing the contact part to protrude from the one end opening of the hollow cylinder. The contact part has a longitudinal shape elongated along an axis of the helical spring part.

DETAILED DESCRIPTION

Figure 1:
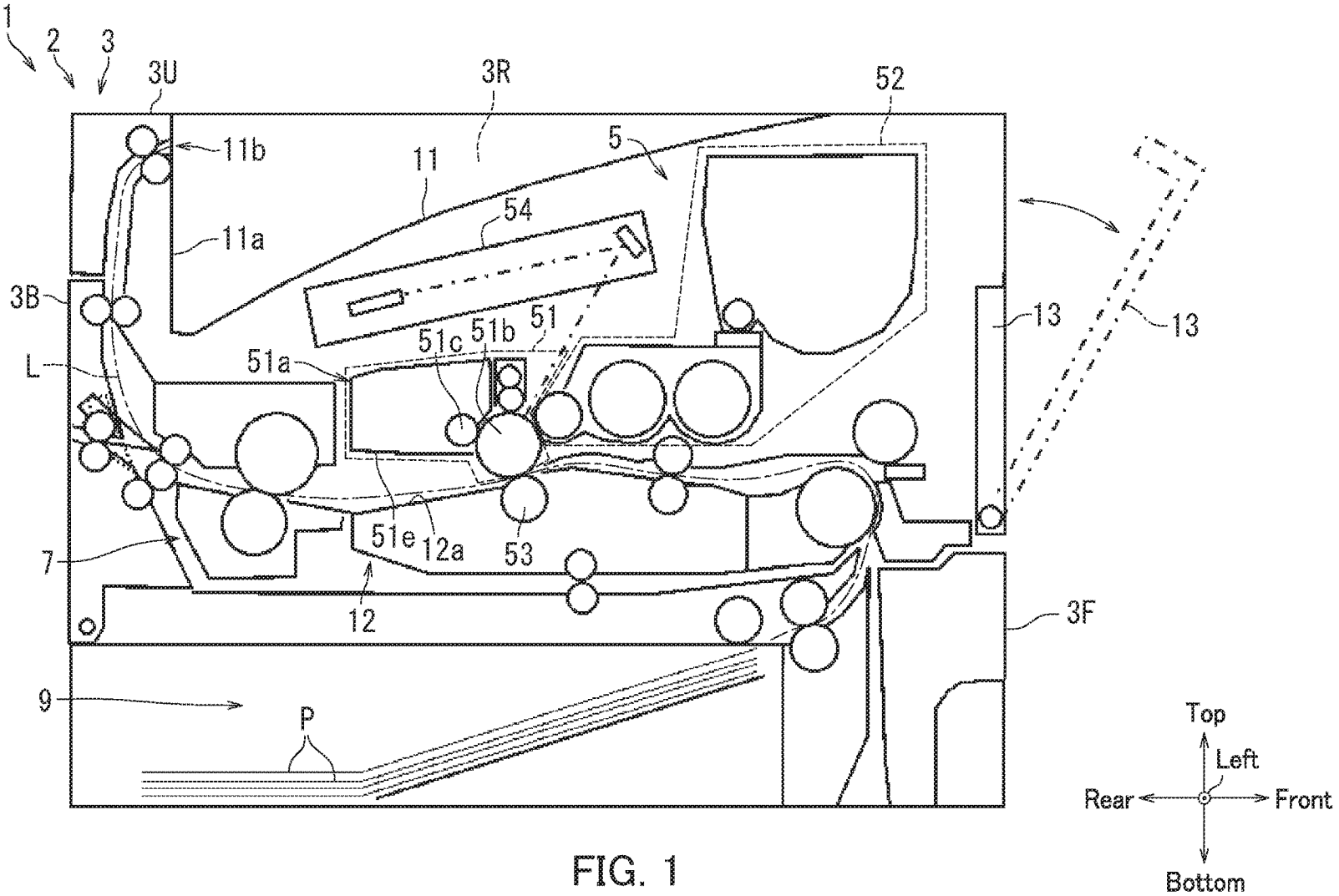
FIG. 1 is a cross-sectional view illustrating an image forming apparatus according to a first embodiment of the present disclosure.

The following describes embodiments of the present disclosure with reference to the drawings. Note that elements in the drawings that are the same or equivalent are labelled with the same reference signs and description thereof is not repeated.

First Embodiment

Figure 2:
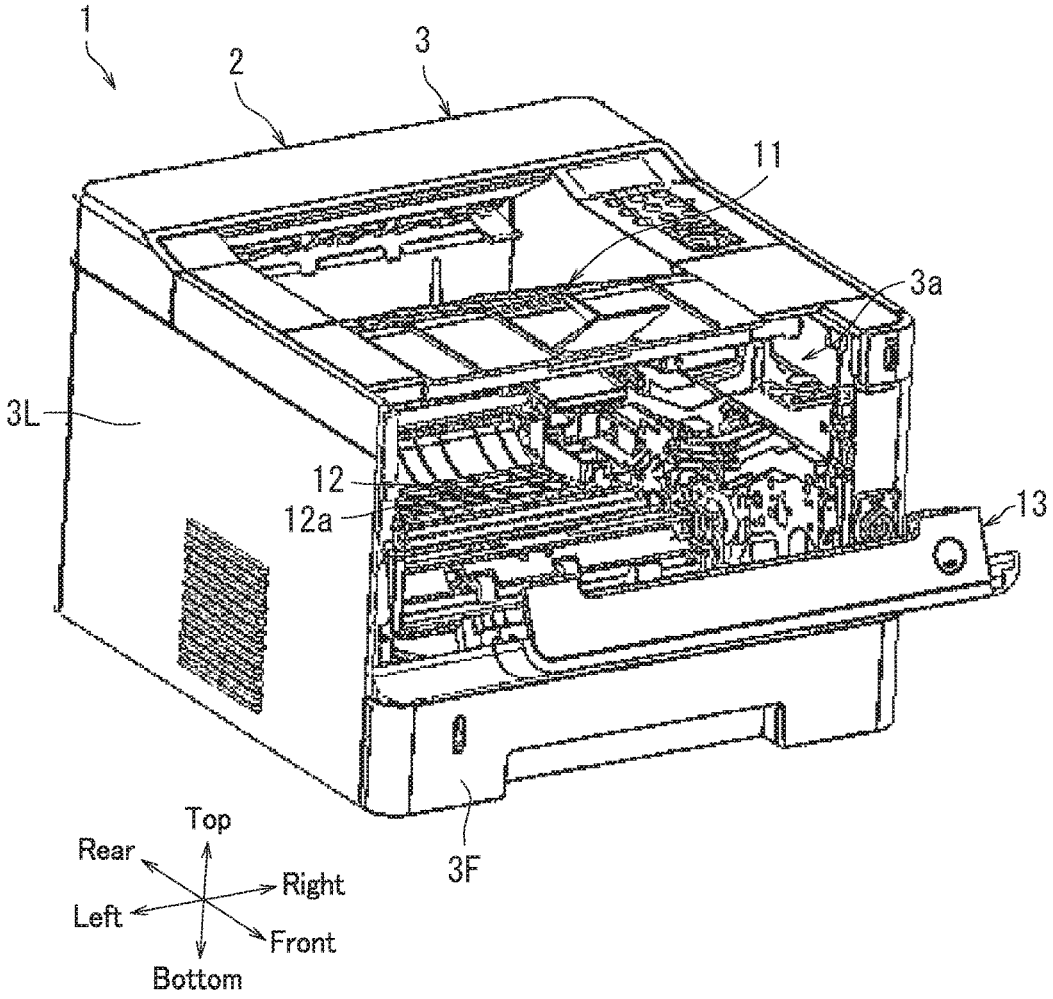
FIG. 2 is a perspective view illustrating the image forming apparatus.

The following describes an image forming apparatus 1 according to a first embodiment of the present disclosure with reference to FIGS. 1 and 2. FIG. 1 is a cross-sectional view illustrating the image forming apparatus 1.

As illustrated in FIG. 1, the image forming apparatus 1 is for example a printer and forms a toner image on paper (a recording medium). The image forming apparatus 1 includes an apparatus main body 2 and an image forming section 5.

The apparatus main body 2 forms a toner image on paper in conjunction with the image forming section 5. The apparatus main body 2 includes an apparatus housing 3, a fixing section 7, a paper feed cassette 9, an exit tray 11, and a paper conveyance path L.

The apparatus housing 3 accommodates the image forming section 5, the fixing section 7, the paper feed cassette 9, and the paper conveyance path L. The apparatus housing 3 is for example in the shape of a substantially rectangular parallelepiped box. The apparatus housing 3 has a front face 3F, a rear face 3B, a left face 3L, and a right face 3R. The left face 3L is located on a near side in FIG. 1 in a direction perpendicular to a plane on which FIG. 1 is illustrated. The right face 3R is located on a far side in FIG. 1 in the direction perpendicular to the plane on which FIG. 1 is illustrated. A side on which the front face 3F is located may be referred to as a front side of the image forming apparatus 1. A side on which the rear face 3B is located may be referred to as a rear side of the image forming apparatus 1. A side on which the left face 3L is located may be referred to as a left side of the image forming apparatus 1. A side on which the right face 3R is located may be referred to as a right side of the image forming apparatus 1.

The paper feed cassette 9 is disposed at a lower location in the apparatus housing 3. The image forming section 5 is disposed above the paper feed cassette 9. The fixing section 7 is disposed behind the image forming section 5. The exit tray 11 is a recess provided in a top face 3U of the apparatus housing 3.

Paper P is ejected onto the exit tray 11. The exit tray 11 has a rear edge portion 11*a* stood substantially in a top-bottom direction. The rear edge portion 11*a* of the exit tray 11 has a paper exit slot 11*b*. The paper exit slot 11*b* is an opening for ejecting the paper P from the apparatus housing 3 to the exit tray 11.

The paper conveyance path L conveys the paper P from the paper feed cassette 9 through the image forming section 5 and the fixing section 7 to the paper exit slot 11*b* in the stated order. The paper feed cassette 9 feeds the paper P to the image forming section 5 through the paper conveyance path L. The image forming section 5 transfers a toner image onto the paper P. After the image forming section 5 performs the image formation process on the paper P, the fixing section 7 applies heat and pressure to the paper P. As a result, the toner image transferred onto the paper P is fixed to the paper P. After the fixing section 7 performs the fixing process on the paper P, the paper P is ejected onto the exit tray 11 through the paper exit slot 11*b*.

The following describes the image forming section 5 in detail.

The image forming section 5 includes a drum unit 51, a developing unit 52, a transfer roller 53, and a light exposure device 54.

The drum unit 51 forms an electrostatic latent image based on image data. The image data is for example image data received by the image forming apparatus 1 from an external device. The drum unit 51 is attachable to and detachable from the apparatus main body 2. The drum unit 51 is disposed in front of the fixing section 7. The drum unit 51 includes a unit housing 51*a*, a photosensitive drum 51*b*, and a charging roller 51*c* (charger). The drum unit 51 corresponds to an example of what may be referred to as a "unit".

The unit housing 51*a* accommodates the photosensitive drum 51*b* and the charging roller 51*c*. The unit housing 51*a* is for example in the shape of a substantially rectangular parallelepiped box. A bottom face 51*e* of the unit housing 51*a* faces toward the paper conveyance path L and guides the paper P along the paper conveyance path L.

The photosensitive drum 51*b* is rotatably disposed at a front end of the unit housing 51*a*. A portion of the photosensitive drum 51*b* protrudes from the bottom face 51*e* of the unit housing 51*a*.

The charging roller 51*c* charges a surface of the photosensitive drum 51*b* to a specific electrical potential. The charging roller 51*c* is rotatably disposed opposite to the photosensitive drum 51*b* (for example, behind the photosensitive drum 51*b*) and is in contact with the photosensitive drum 51*b*. A charging voltage for charging the photosensitive drum 51*b* to the specific electric potential is applied to the charging roller 51*c*.

The light exposure device 54 irradiates the surface of the charged photosensitive drum 51*b* with laser light to form an electrostatic latent image on the surface of the photosensitive drum 51*b* based on image data. The light exposure device 54 is disposed opposite to the photosensitive drum 51*b* (for example, above the photosensitive drum 51*b*).

The developing unit 52 develops the electrostatic latent image formed on the surface of the photosensitive drum 51*b* into a toner image. As a result, the toner image is formed on the surface of the photosensitive drum 51*b*. The developing unit 52 is attachable to and detachable from the apparatus main body 2. The developing unit 52 is disposed in front of the drum unit 51.

The transfer roller 53 transfers the toner image from the surface of the photosensitive drum 51*b* to the paper P. The transfer roller 53 is rotatably disposed in the apparatus main body 2. The transfer roller 53 and the photosensitive drum 51*b* form a transfer nip therebetween. As the paper P passes through the transfer nip, the toner image formed on the surface of the photosensitive drum 51*b* is transferred onto the paper P.

The image forming apparatus 1 further includes a conveyance unit 12.

The conveyance unit 12 forms a part of the paper conveyance path L. The conveyance unit 12 is disposed under the image forming section 5 with the paper conveyance path L therebetween. The conveyance unit 12 is for example in the shape of a flattened rectangular parallelepiped box. A top face 12*a* of the conveyance unit 12 faces toward the paper conveyance path L and guides the paper P along the paper conveyance path L. The top face 12*a* has a recessed groove. The transfer roller 53 is rotatably disposed in the recessed groove.

The following further describes the image forming apparatus 1 with reference to FIG. 2. FIG. 2 is a perspective view illustrating the image forming apparatus 1.

As illustrated in FIG. 2, the image forming apparatus 1 further includes a cover 13. The apparatus housing 3 has an opening 3*a*.

The opening 3*a* exposes the inside of the apparatus housing 3. The opening 3*a* is formed in the front face 3F of the apparatus housing 3. The cover 13 covers and uncovers the opening 3*a*. The cover 13 is openable and closable relative to the apparatus housing 3. More specifically, a lower portion of the cover 13 is pivotally connected to the apparatus housing 3. The cover 13 pivots at the lower portion of the cover 13 to be open or closed relative to the apparatus housing 3.

The drum unit 51 and the developing unit 52 described with reference to FIG. 1 can be taken out of the apparatus housing 3 through the opening 3*a* of the apparatus housing 3.

The following specifically describes detachment of the drum unit 51 and the developing unit 52 from the apparatus main body 2 with reference to FIGS. 1 and 2. First, the developing unit 52 is drawn toward the front side of the apparatus main body 2 and thereby detached from the apparatus main body 2 through the opening 3*a*. Subsequently, the drum unit 51 is drawn toward the front side of the apparatus main body 2 and thereby detached from the apparatus main body 2 through the opening 3*a*.

For attaching the drum unit 51 and the developing unit 52 to the apparatus main body 2, the drum unit 51 is first inserted in the apparatus main body 2 to a specific position through the opening 3*a* and thereby attached to the apparatus main body 2. Subsequently, the developing unit 52 is inserted in the apparatus main body 2 to a specific position in front of the drum unit 51 through the opening 3*a* and thereby attached to the apparatus main body 2. Note that the drum unit 51 and the developing unit 52 are not illustrated in FIG. 2.

Figure 3:
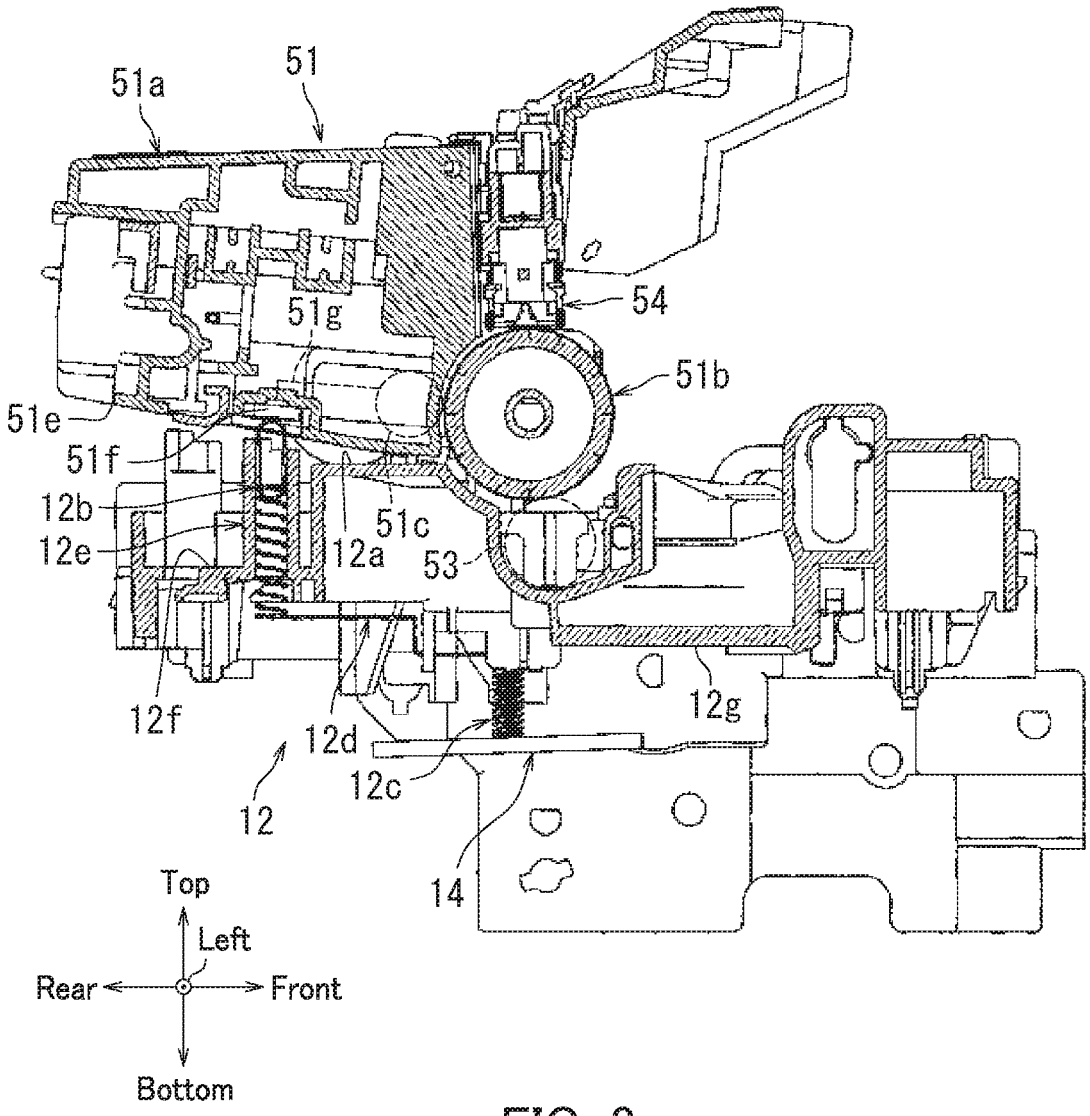
FIG. 3 is a cross-sectional view illustrating a conveyance unit and a drum unit.

The following further describes the conveyance unit 12 and the drum unit 51 with reference to FIG. 3. FIG. 3 is a cross-sectional view illustrating the conveyance unit 12 and the drum unit 51. FIG. 3 illustrates a positional relationship between the conveyance unit 12 and the drum unit 51 when the drum unit 51 is mounted in the apparatus main body 2.

As illustrated in FIG. 3, the drum unit 51 further includes a conductive member 51*f* and a wire 51*g*.

The conductive member 51*f* functions as an input terminal that receives input of a charging voltage for charging the charging roller 51*c*. The conductive member 51*f* is disposed on the bottom face 51*e* of the unit housing 51*a*. More specifically, the conductive member 51*f* is disposed in a recess formed in the bottom face 51*e*. The wire 51*g* transfers the charging voltage input into the conductive member 51*f* to the charging roller 51*c*. The wire 51*g* is disposed inside of the unit housing 51*a* and connects the conductive member 51*f* with the charging roller 51*c* in an electrically conductive manner.

The conveyance unit 12 further includes a contact spring 12*b*, a helical spring 12*c*, and a wiring member (wire) 12*d*. The apparatus main body 2 further includes a power source substrate 14.

The contact spring 12*b* is in electrically conductive contact with the conductive member 51*f*. The contact spring 12*b* is disposed at a right angle relative to the top face 12*a* of the conveyance unit 12. A distal end of the contact spring 12*b* protrudes from the top face 12*a* and is in electrically conductive contact with the conductive member 51*f*. The distal end of the contact spring 12*b* applies pressure on the conductive member 51*f* with its compression rebound. As a result, the distal end of the contact spring 12*b* is in electrically conductive contact with the conductive member 51*f*.

More specifically, the top face 12*a* of the conveyance unit 12 has a recess 12*f*. A hollow cylinder 12*e* is stood on a bottom of the recess 12*f*. The hollow cylinder 12*e* retains the contact spring 12*b*. The hollow cylinder 12*e* for example has a cylindrical shape having a distal end opening (one end opening) and a proximal end opening. The proximal end opening of the hollow cylinder 12*e* opens at a lower surface of the bottom of the recess 12*f*. The contact spring 12*b* is disposed in the hollow cylinder 12*e*. As a result, the contact spring 12*b* is retained upright relative to the top face 12*a*. The distal end of the contact spring 12*b* protrudes from the distal end opening of the hollow cylinder 12*e* and is in electrically conductive contact with the conductive member 51*f*.

The helical spring 12*c* is in electrically conductive contact with the power source substrate 14. The helical spring 12*c* is disposed at a right angle relative to a bottom face 12*g* of the conveyance unit 12. The helical spring 12*c* protrudes from the bottom face 12*g*. A distal end of the helical spring 12*c* is in electrically conductive contact with the power source substrate 14. The distal end of the helical spring 12*c* applies pressure on the power source substrate 14 with its compression rebound. As a result, the distal end of the helical spring 12*c* is in electrically conductive contact with the power source substrate 14.

The wiring member 12*d* connects the contact spring 12*b* and the helical spring 12*c* in an electrically conductive manner. The wiring member 12*d* is disposed in the conveyance unit 12. The wiring member 12*d* is for example a long and thin plate member. The contact spring 12*b*, the helical spring 12*c*, and the wiring member 12*d* may be provided as one member formed of a conductive and elastic wire. One end of the wiring member 12*d* is in electrically conductive contact with the proximal end of the contact spring 12*b*. The one end of the wiring member 12*d* supports the contact spring 12*b* so as to prevent the contact spring 12*b* from coming out through the proximal end opening of the hollow cylinder 12*e*. The other end of the wiring member 12*d* is in electrically conductive contact with a proximal end of the helical spring 12*c*.

The power source substrate 14 is for example disposed in the apparatus housing 3. The power source substrate 14 supplies voltage (for example, high voltage). The voltage supplied by the power source substrate 14 is applied to the charging roller 51*c* through the helical spring 12*c*, the wiring member 12*d*, the contact spring 12*b*, the conductive member 51*f*, and the wire 51*g*.

Figure 4:
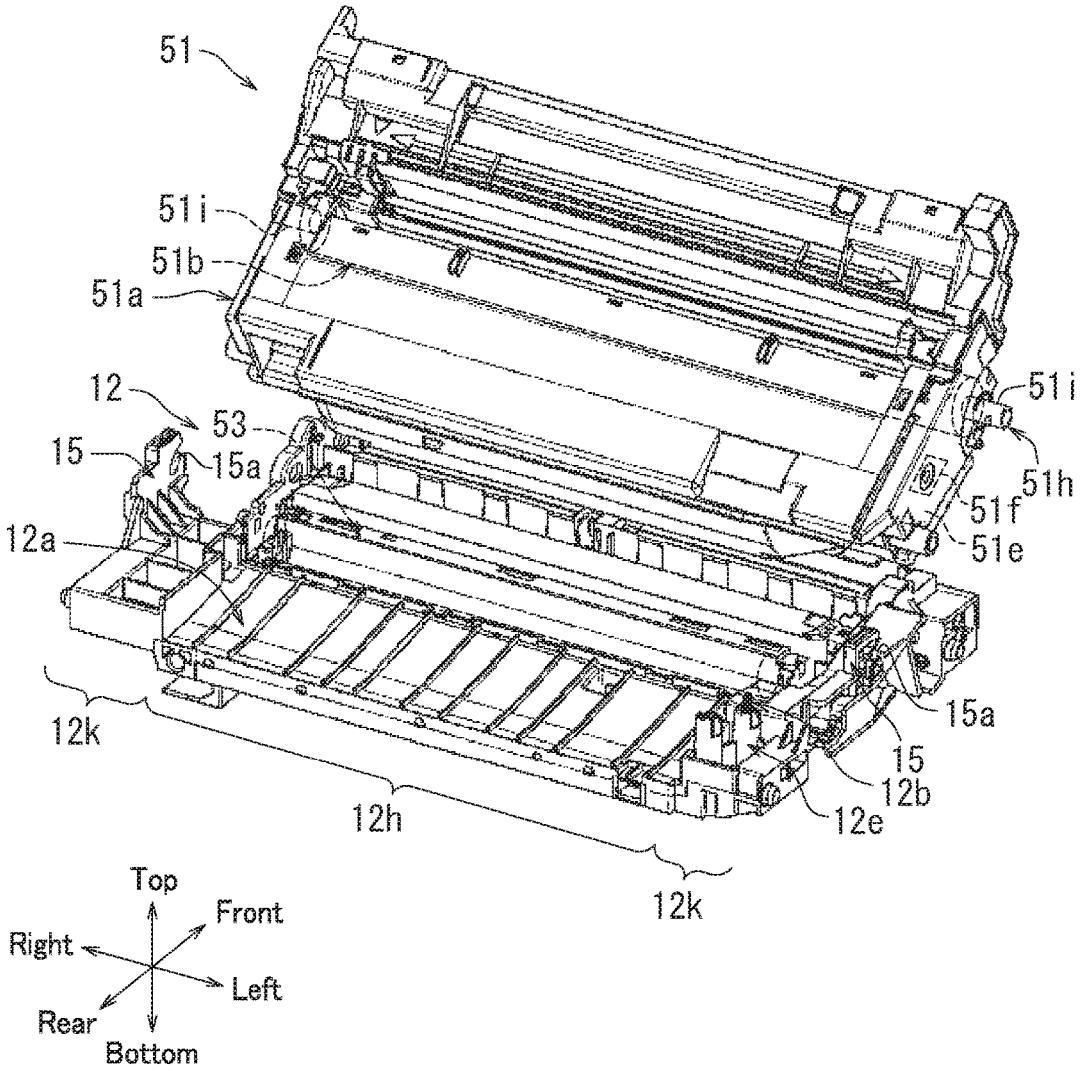
FIG. 4 is an exploded perspective view illustrating the conveyance unit and the drum unit.

The following further describes the conveyance unit 12 and the drum unit 51 with reference to FIG. 4. FIG. 4 is an exploded perspective view illustrating the conveyance unit 12 and the drum unit 51.

As illustrated in FIG. 4, the photosensitive drum 51*b* has a rotation shaft 51*h*. Opposite end sections 51*i*, 51*i* of the rotation shaft 51*h* respectively protrude from right and left side faces of the unit housing 51*a*.

The conveyance unit 12 includes a pair of engagement sections 15, 15. The pair of engagement sections 15, 15 engage with the opposite end sections 51*i*, 51*i* of the rotation shaft 51*h* of the photosensitive drum 51*b*.

More specifically, the top face 12*a* of the conveyance unit 12 has a guide region 12*h* and two non-guide regions 12*k*, 12*k*. The guide region 12*h* is a region that guides paper along the paper conveyance path L. The two non-guide regions 12*k*, 12*k* are located at left and right sides of the guide region 12*h*. The left and right sides of the guide region 12*h* refer to sides in a lateral direction that is perpendicular to a paper conveyance direction. The pair of engagement sections 15, 15 are provided in the two non-guide regions 12*k*, 12*k*.

The pair of engagement sections 15, 15 each have a cut 15*a*. Each opposite end section 51*i* of the rotation shaft 51*h* of the photosensitive drum 51*b* fits in a corresponding one of the cuts 15*a*. As a result, each opposite end section 51*i* engages with a corresponding one of the engagement sections 15.

With the drum unit 51 attached to the apparatus main body 2 as illustrated in FIG. 1, the opposite end sections 51*i* of the rotation shaft 51*h* of the drum unit 51 engage with the pair of engagement sections 15 of the conveyance unit 12. As a result, the drum unit 51 is positioned relative to the conveyance unit 12.

The following describes the hollow cylinder 12*e* and the conductive member 51*f* with reference to FIG. 4.

The hollow cylinder 12*e* is provided in one of the two non-guide regions 12*k*, 12*k*. More specifically, the hollow cylinder 12*e* is provided in a rear portion of the left non-guide region 12*k* (in a rear portion at a left edge of the top face 12*a*). That is, the contact spring 12*b* is disposed in a rear portion of the left non-guide region 12*k*.

The conductive member 51*f* is disposed at one of left and right edges of the bottom face 51*e* of the unit housing 51*a*. More specifically, the conductive member 51*f* is disposed in a rear portion at the left edge of the bottom face 51*e*. That is, the conductive member 51*f* is disposed on the bottom face 51*e* at a position corresponding to the contact spring 12*b*.

Figure 5:
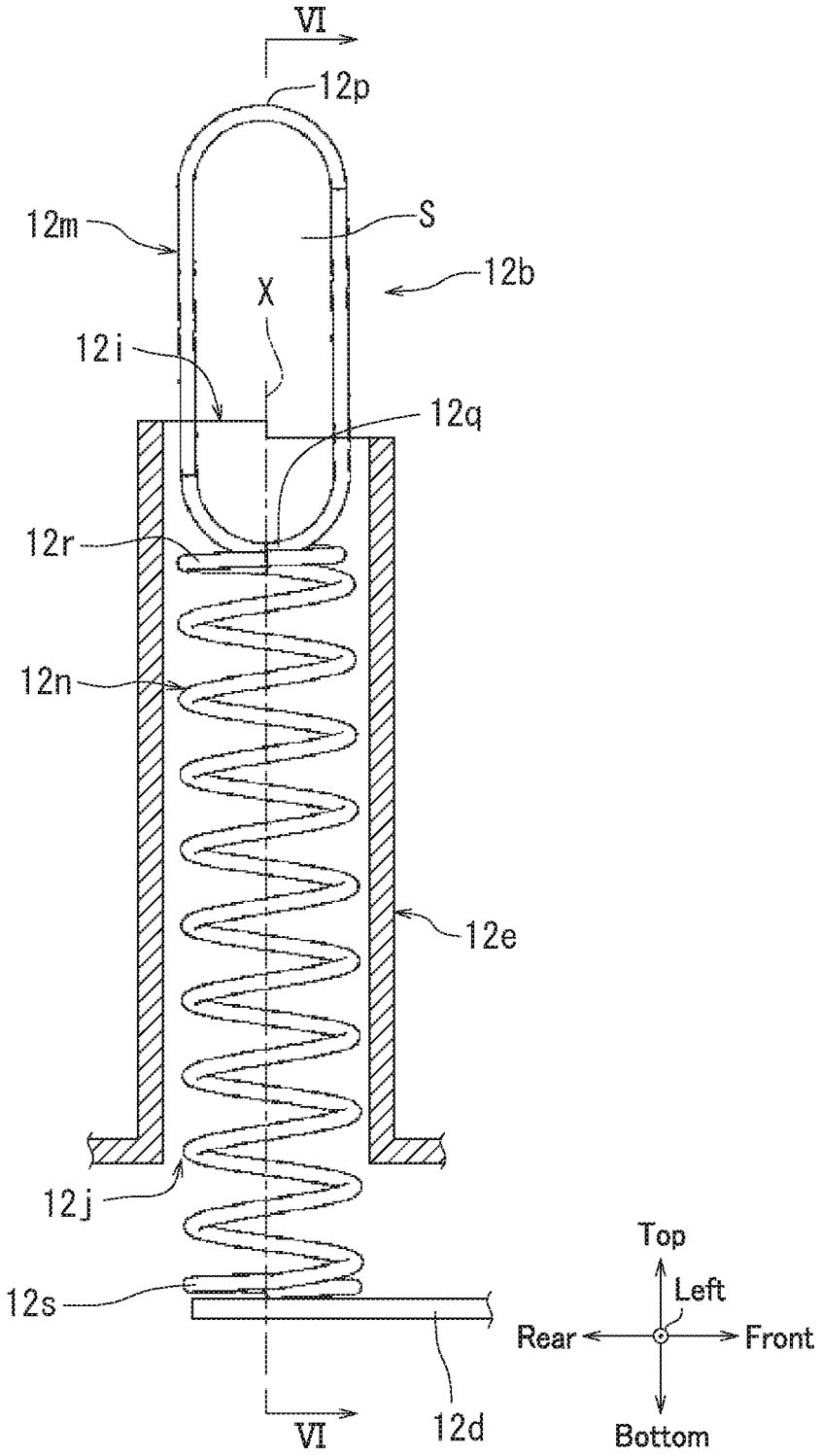
FIG. 5 is a cross-sectional view illustrating a contact spring and a hollow cylinder according to the first embodiment.

The following further describes the contact spring 12*b* and the hollow cylinder 12*e* with reference to FIG. 5. FIG. 5 is a cross-sectional view illustrating the contact spring 12*b* and the hollow cylinder 12*e*.

As illustrated in FIG. 5, the contact spring 12*b* has a contact part 12*m* and a helical spring part 12*n*.

The helical spring part 12*n* is for example a hollow cylindrical compression coil spring. The helical spring part 12*n* is compressible along an axis X of the helical spring part 12*n*. A portion of the helical spring part 12*n* is contained within the hollow cylinder 12*e*. A proximal end 12*s* of the helical spring part 12*n* protrudes from a proximal end opening 12*j* of the hollow cylinder 12*e* and is in contact with the wiring member 12*d*. As a result, the contact spring 12*b* is prevented from coming out through the proximal end opening 12*j* of the hollow cylinder 12*e*.

The contact part 12*m* is in electrically conductive contact with the conductive member 51*f* described with reference to FIGS. 3 and 4. A proximal end 12*q* of the contact part 12*m* is integral with a distal end 12*r* (one end) of the helical spring part 12*n*. The contact part 12*m* is disposed along a plane including the axis X of the helical spring part 12*n*. Accordingly, opposite main surfaces S of the contact part 12*m* are located within the plane in parallel with the axis X of the helical spring part 12*n*. The plane in parallel with the axis X of the helical spring part 12*n* is for example in parallel with a front-rear direction of the image forming apparatus 1 (a direction in which the drum unit 51 is attached to the apparatus main body 2).

The contact part 12*m* is retractable in and out of the hollow cylinder 12*e* through a distal end opening 12*i* (one end opening) of the hollow cylinder 12*e*. More specifically, a portion of the contact part 12*m* at the proximal end 12*q* is contained within the hollow cylinder 12*e*, and a portion of the contact part 12*m* other than the portion at the proximal end 12*q* protrudes from the distal end opening 12*i* of the hollow cylinder 12*e*. As a result of the portion of the contact part 12*m* at the proximal end 12*q* being contained within the hollow cylinder 12*e*, the contact part 12*m* is prevented from being inclined relative to the axis X of the helical spring part 12*n* upon the contact part 12*m* coming in contact with the conductive member 51*f*.

The contact part 12*m* is urged by the compression rebound of the helical spring part 12*n* to protrude from the distal end opening 12*i* of the hollow cylinder 12*e*.

The contact part 12*m* has a longitudinal shape elongated along the axis X of the helical spring part 12*n*. As a result, it is possible to ensure that the portion of the contact part 12*m* other than the portion at the proximal end 12*q* (the portion that protrudes from the distal end opening 12*i* of the hollow cylinder 12*e*) has a sufficient length.

More specifically, the contact part 12*m* is in the shape of a rectangular ring elongated along the axis X of the helical spring part 12*n*. A distal end 12*p* of the contact part 12*m* is curved outwardly into an arc shape. Being curved outwardly into an arc shape, the distal end 12*p* of the contact part 12*m* can smoothly come in contact with the conductive member 51*f*. In a specific example described with reference to FIG. 5, the contact part 12*m* has an oval shape elongated along the axis X, and the opposite main surfaces S of the contact part 12*m* are open faces.

The opposite main surfaces S of the contact part 12*m* are in parallel with the front-rear direction of the image forming apparatus 1 (a direction in which the drum unit 51 is attached to the apparatus main body 2). Accordingly, the conductive member 51*f* can slide along an arc of the distal end 12*p* of the contact part 12*m* when the conductive member 51*f* comes in contact with the distal end 12*p*. As a result, the conductive member 51*f* can further smoothly come in contact with the distal end 12*p*.

The following describes movement of the contact spring 12*b* with reference to FIG. 5.

Once the distal end 12*p* of the contact part 12*m* comes in contact with the conductive member 51*f* described with reference to FIG. 3, the contact part 12*m* is pushed into the hollow cylinder 12*e* by the conductive member 51*f*. The helical spring part 12*n* is compressed by a distance corresponding to a distance by which the contact part 12*m* is pushed into the hollow cylinder 12*e*. As a result, the contact part 12*m* and the conductive member 51*f* can be in electrically conductive contact with one another even if a distance between the contact part 12*m* and the conductive member 51*f* is shorter than designed. Since the contact part 12*m* has a longitudinal shape elongated along the axis X, it is ensured that the helical spring part 12*n* has a sufficiently long stroke. As a result, the contact part 12*m* and the conductive member 51*f* can be in electrically conductive contact with one another even if the contact part 12*m* and the conductive member 51*f* are in too close contact. The stroke of the helical spring part 12*n* refers to a length by which the helical spring part 12*n* is compressed when the contact part 12*m* is pushed into the hollow cylinder 12*e* by the conductive member 51*f*.

As a result of the portion of the contact part 12*m* at the proximal end 12*q* being contained within the hollow cylinder 12*e*, the contact part 12*m* is prevented from being inclined by the conductive member 51*f* relative to the axis X. Since the contact part 12*m* has a longitudinal shape elongated along the axis X, it is possible to ensure that the helical spring part 12*n* has a sufficiently long stroke even though the portion at the proximal end 12*q* is contained within the hollow cylinder 12*e*.

Figure 6:
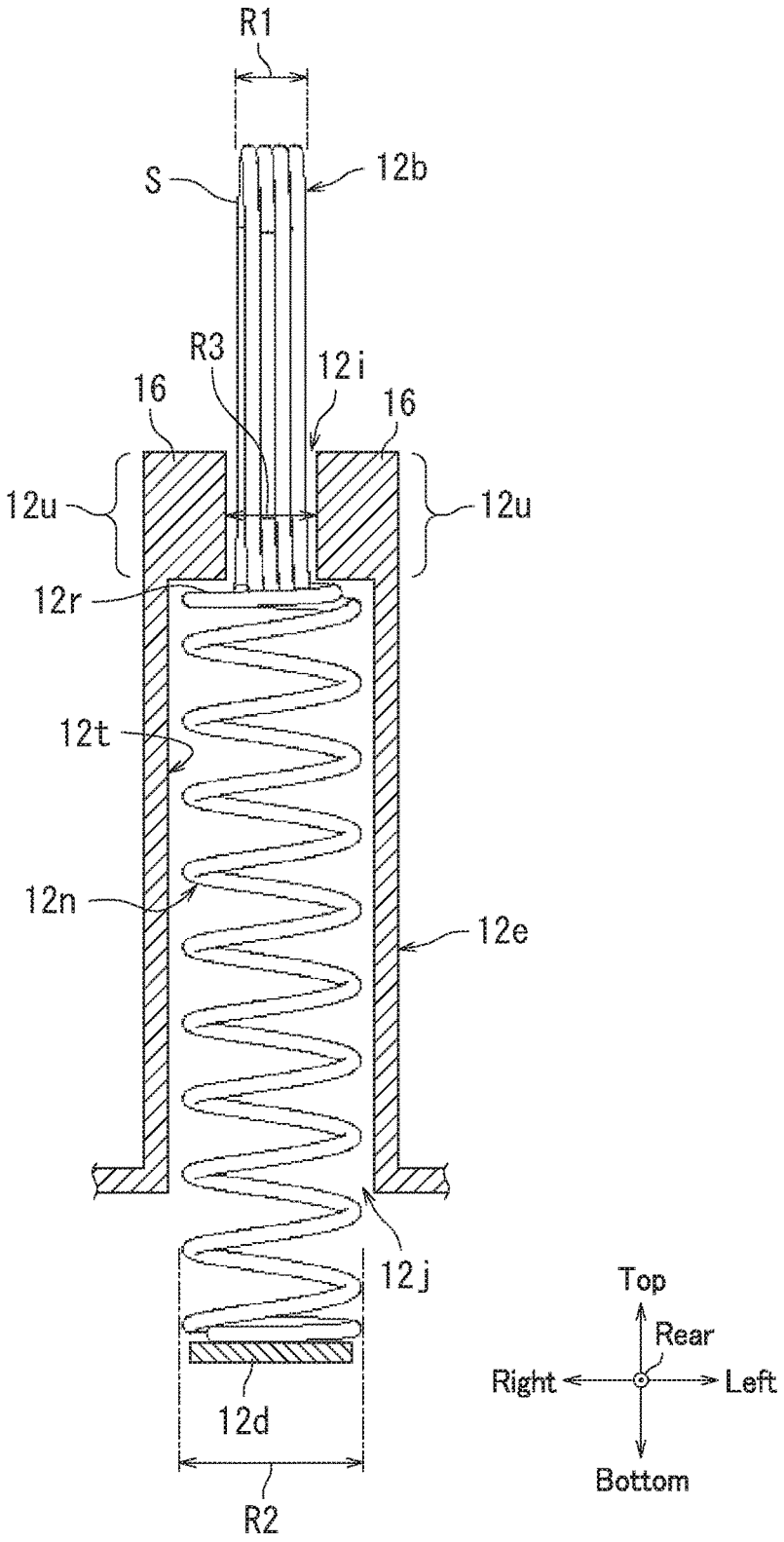
FIG. 6 is a cross-sectional view taken along line VI-VI in FIG. 5.
Figure 7:
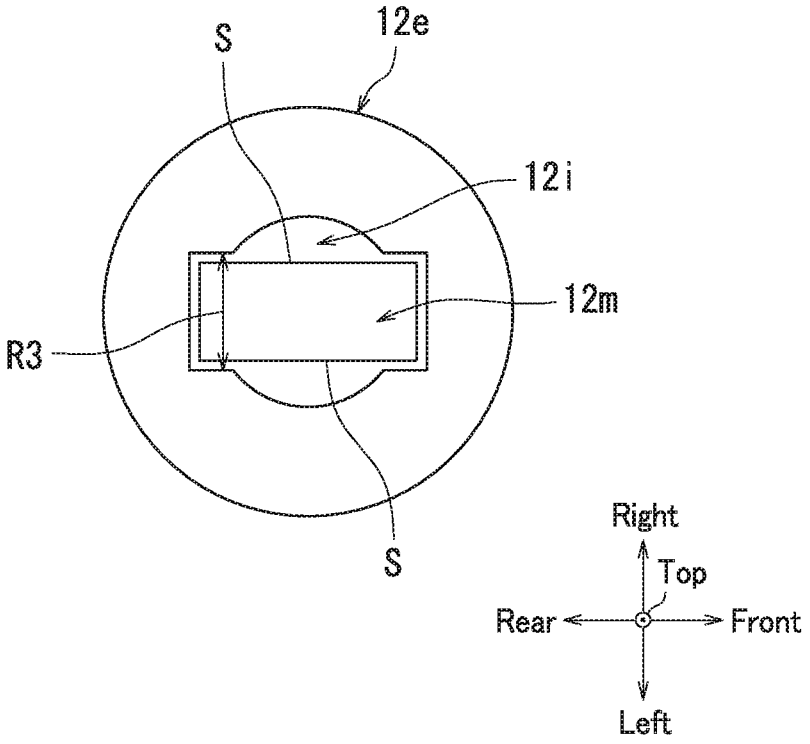
FIG. 7 is a top plan view of a distal end opening of the hollow cylinder.

The following describes the contact spring 12*b* and the hollow cylinder 12*e* in detail with reference to FIGS. 6 and 7. FIG. 6 is a cross-sectional view taken along line VI-VI in FIG. 5. FIG. 7 is a top plan view of the distal end opening 12*i* of the hollow cylinder 12*e*.

As illustrated in FIG. 6, a width R1 of the contact part 12*m* in a left-right direction is smaller than a diameter R2 of the helical spring part 12*n*.

The hollow cylinder 12*e* has a pair of projections 16, 16. The pair of projections 16, 16 prevent the helical spring part 12*n* from coming out through the distal end opening 12*i* of the hollow cylinder 12*e*.

The pair of projections 16, 16 are provided on left and right sides of the hollow cylinder 12*e* at a periphery 12*u* located toward the distal end opening 12*i*.

The pair of projections 16, 16 protrude inward from an inner circumferential surface 12*t* of the hollow cylinder 12*e*. A distance R3 between the pair of projections 16, 16 is slightly larger than the width R1 of the contact part 12*m*. The distal end opening 12*i* of the hollow cylinder 12*e* is located between the pair of projections 16, 16. The contact part 12*m* is disposed between the pair of projections 16, 16. The pair of projections 16, 16 support the contact part 12*m* in a retractable manner.

With the distal end 12*r* of the helical spring part 12*n* abutting the pair of projections 16, 16, the helical spring part 12*n* is prevented from coming out through the distal end opening 12*i* of the hollow cylinder 12*e*.

As illustrated in FIG. 7, the distal end opening 12*i* of the hollow cylinder 12*e* is elongated in the front-rear direction of the image forming apparatus 1. The front-rear direction of the image forming apparatus 1 is a direction perpendicular to a direction of an axis of the hollow cylinder 12*e*. The contact part 12*m* is disposed in the distal end opening 12*i* such that the opposite main surfaces S are along a longitudinal direction of the distal end opening 12*i*. As a result, the orientation of the contact part 12*m* is fixed with the opposite main surfaces S of the contact part 12*m* along the distal end opening 12*i*.

Second Embodiment

Figure 8:
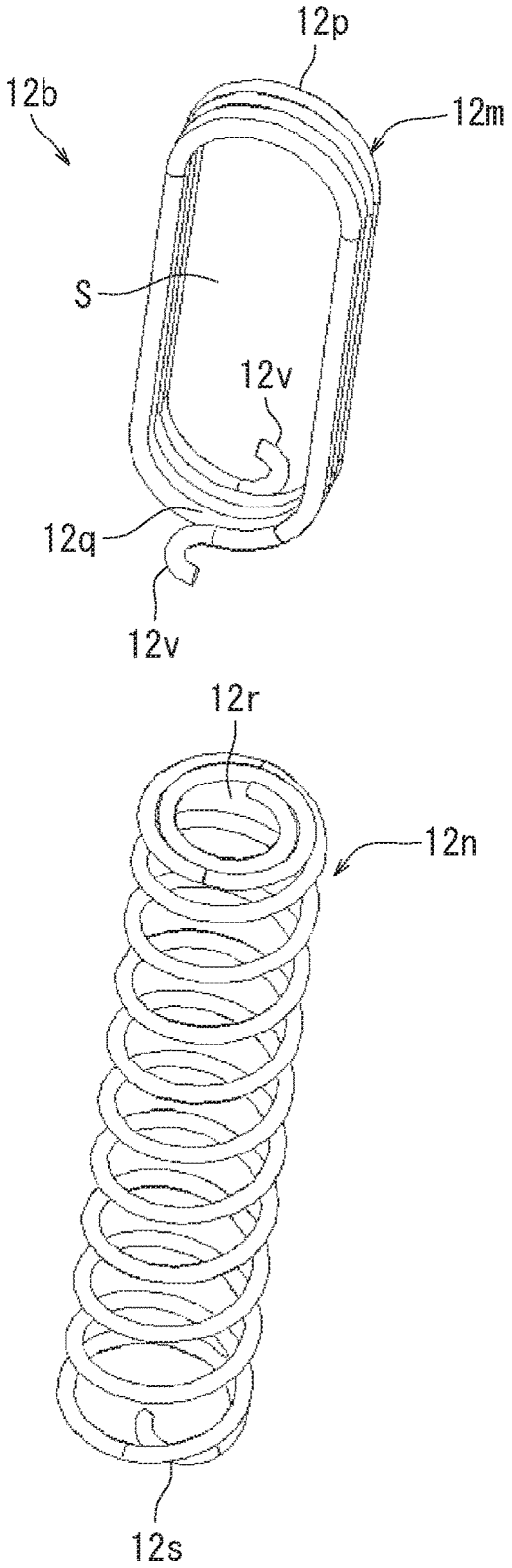
FIG. 8 is an exploded perspective view illustrating a contact spring according to a second embodiment of the present disclosure.
Figure 9:
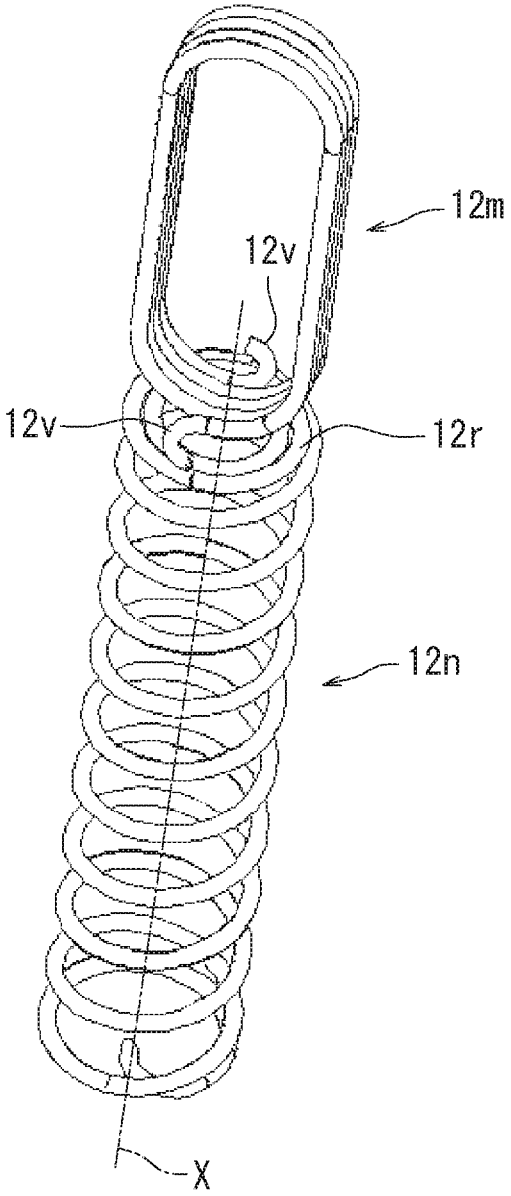
FIG. 9 is a perspective view illustrating the contact spring according to the second embodiment.
Figure 10:
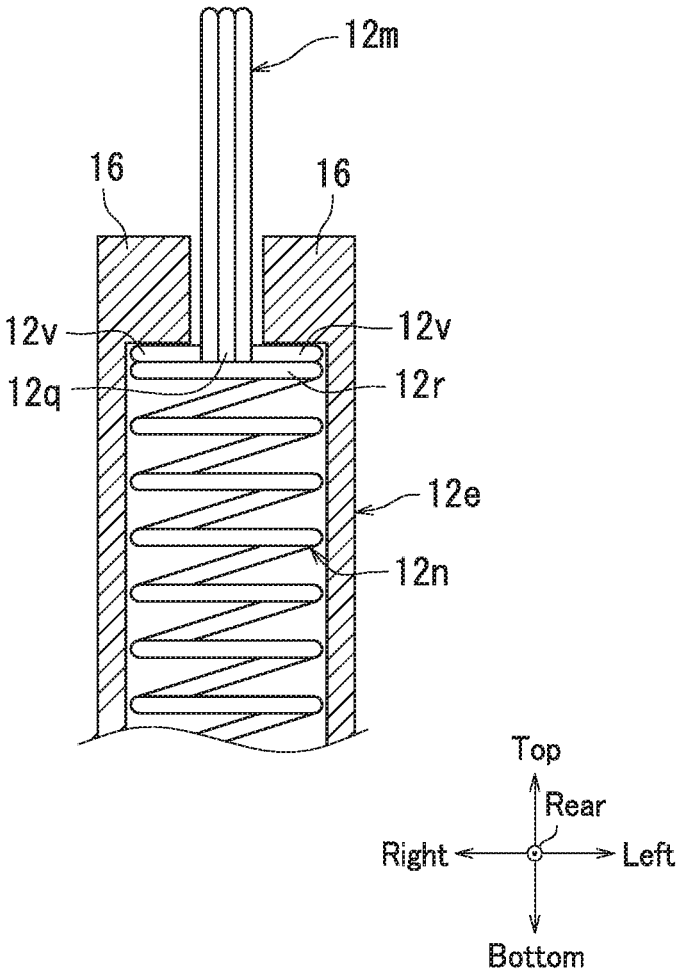
FIG. 10 is a cross-sectional view illustrating the contact spring according to the second embodiment contained in the hollow cylinder.

The following describes the image forming apparatus 1 according to a second embodiment of the present disclosure with reference to FIGS. 8 to 10. FIG. 8 is an exploded perspective view illustrating the contact spring 12*b* according to the second embodiment. FIG. 9 is a perspective view illustrating the contact spring 12*b*.

The contact spring 12*b* according to the second embodiment is different from the contact spring 12*b* according to the first embodiment in that the contact part 12*m* and the helical spring part 12*n* according to the second embodiment are separate parts. Since the contact part 12*m* and the helical spring part 12*n* are separate parts, the contact spring 12*b* is readily attached to the conveyance unit 12.

Elements in the second embodiment that are the same as those in the first embodiment are indicated by the same reference signs as those in the first embodiment, and description thereof is omitted. The following describes the second embodiment based on differences compared to the first embodiment.

As illustrated in FIG. 8, the contact spring 12*b* has the contact part 12*m* and the helical spring part 12*n*.

The contact part 12*m* and the helical spring part 12*n* are separate parts. The contact part 12*m* and the helical spring part 12*n* according to the second embodiment are the contact part 12*m* and the helical spring part 12*n* according to the first embodiment that are formed as separate parts.

The contact part 12*m* has a pair of protrusions 12*v*, 12*v*. The pair of protrusions 12*v*, 12*v* are integral with the proximal end 12*q* of the contact part 12*m* and protrude in a direction perpendicular to the opposite main surfaces S of the contact part 12*m*. In other words, the pair of protrusions 12*v*, 12*v* protrude in a direction perpendicular to a longitudinal direction of the contact part 12*m*. Each of the pair of protrusions 12*v*, 12*v* for example has an arc shape.

As illustrated in FIG. 9, the contact part 12*m* is disposed at the distal end 12*r* of the helical spring part 12*n*. While the contact part 12*m* is disposed at the distal end 12*r* of the helical spring part 12*n*, the contact part 12*m* is along the axis X of the helical spring part 12*n*, and the pair of protrusions 12*v*, 12*v* are in electrically conductive contact with the distal end 12*r* of the helical spring part 12*n*.

The following describes a method for containing the contact spring 12*b* in the hollow cylinder 12*e* with reference to FIG. 10. FIG. 10 is a cross-sectional view illustrating the contact spring 12*b* contained in the hollow cylinder 12*e*.

As illustrated in FIG. 10, the portion of the contact part 12*m* at the proximal end 12*q* and a portion of the helical spring part 12*n* at the distal end 12*r* are located within the hollow cylinder 12*e*. The pair of protrusions 12*v*, 12*v* of the contact part 12*m* are contained within the hollow cylinder 12*e*. The pair of protrusions 12*v*, 12*v* are disposed between the pair of projections 16, 16 and the distal end 12*r* of the helical spring part 12*n*. With the pair of protrusions 12*v*, 12*v* abutting the pair of projections 16, 16, the contact part 12*m* is prevented from coming out through the distal end opening 12*i* of the hollow cylinder 12*e*. The distal end 12*r* of the helical spring part 12*n* applies pressure on the pair of protrusions 12*v*, 12*v* with the compression rebound of the helical spring part 12*n*. As a result, the pair of protrusions 12*v*, 12*v* are in electrically conductive contact with the distal end 12*r*.

Embodiments of the present disclosure have been described above with reference to the drawings (FIGS. 1 to 10). However, the present disclosure is not limited to the above embodiments and may be implemented in various different forms that do not deviate from the essence of the present disclosure. The drawings schematically illustrate elements of configuration in order to facilitate understanding and properties of elements of configuration illustrated in the drawings, such as thickness, length, and number thereof, may differ from actual properties thereof in order to facilitate preparation of the drawings. Furthermore, properties of elements of configuration described in the above embodiments, such as material properties, shapes, and dimensions, are merely examples and are not intended as specific limitations. Various alterations may be made so long as there is no substantial deviation from the effects of the present disclosure.

What is claimed is:

1. An image forming apparatus comprising:

an apparatus main body;

a unit attachable to and detachable from the apparatus main body;

a conductive member disposed in the unit;

a contact spring disposed in the apparatus main body and configured to come in electrically conductive contact with the conductive member; and a hollow cylinder disposed in the apparatus main body, the hollow cylinder retaining the contact spring, wherein the apparatus main body forms an image on a recording medium in conjunction with the unit, the contact spring has a helical spring part and a contact part provided on one end of the helical spring part, the contact part protrudes from one end opening of the hollow cylinder, and is retractable in and out of the hollow cylinder through the one end opening, the helical spring part is contained in the hollow cylinder and urges the contact part in a direction for causing the contact part to protrude from the one end opening of the hollow cylinder, the contact part has a longitudinal shape elongated along an axis of the helical spring part, the hollow cylinder has a projection that protrudes inward from an inner circumferential surface of the hollow cylinder, the projection forms a portion of the one end opening of the hollow cylinder, and the one end of the helical spring part abuts the projection.

2. The image forming apparatus according to claim 1, wherein a portion of the contact part at a proximal end thereof is contained within the hollow cylinder.

3. The image forming apparatus according to claim 1, wherein the one end opening of the hollow cylinder has a shape elongated in a direction perpendicular to an axis of the hollow cylinder.

4. The image forming apparatus according to claim 3, wherein the one end opening of the hollow cylinder has a shape elongated in a direction in which the unit is attached to the apparatus main body.

5. The image forming apparatus according to claim 1, wherein the projection includes a pair of members symmetrical to one another with respect to a plane including an axis of the hollow cylinder, and the contact part is disposed between the pair of members.

6. The image forming apparatus according to claim 1, wherein the projection supports the contact part such that the contact part is retractable in and out of the hollow cylinder.

7. The image forming apparatus according to claim 1, wherein opposite main surfaces of the contact part are disposed along a plane that includes an axis of the helical spring part and that is in parallel with a direction in which the unit is attached to the apparatus main body.

8. The image forming apparatus according to claim 1, wherein a distal end of the contact part has an arc shape.

9. The image forming apparatus according to claim 1, wherein the contact part has an oval shape.

10. The image forming apparatus according to claim 1, wherein the unit further includes a photosensitive drum and a charger configured to charge the photosensitive drum, and the conductive member is in electrically conductive communication with the charger.

11. An image forming apparatus comprising:

an apparatus main body;

a unit attachable to and detachable from the apparatus main body;

a conductive member disposed in the unit;

a contact spring disposed in the apparatus main body and configured to come in electrically conductive contact with the conductive member; and a hollow cylinder disposed in the apparatus main body, the hollow cylinder retaining the contact spring, wherein the apparatus main body forms an image on a recording medium in conjunction with the unit, the contact spring has a helical spring part and a contact part provided on one end of the helical spring part, the contact part protrudes from one end opening of the hollow cylinder, and is retractable in and out of the hollow cylinder through the one end opening, the helical spring part is contained in the hollow cylinder and urges the contact part in a direction for causing the contact part to protrude from the one end opening of the hollow cylinder, the contact part has a longitudinal shape elongated along an axis of the helical spring part, the helical spring part and the contact part are separate parts, the contact part has a protrusion, and the protrusion protrudes from a proximal end of the contact part in a direction perpendicular to a longitudinal direction of the contact part and is in electrically conductive contact with the one end of the helical spring part.

12. The image forming apparatus according to claim 11, wherein the hollow cylinder has a projection that protrudes inward from an inner circumferential surface of the hollow cylinder, the projection forms a portion of the one end opening of the hollow cylinder, and the protrusion is disposed between the one end of the helical spring part and the projection.

13. An image forming apparatus comprising:

an apparatus main body;

a unit attachable to and detachable from the apparatus main body;

a conductive member disposed in the unit;

a contact spring disposed in the apparatus main body and configured to come in electrically conductive contact with the conductive member; and a hollow cylinder disposed in the apparatus main body, the hollow cylinder retaining the contact spring, wherein the apparatus main body forms an image on a recording medium in conjunction with the unit, the contact spring has a helical spring part and a contact part provided on one end of the helical spring part, the contact part protrudes from one end opening of the hollow cylinder, and is retractable in and out of the hollow cylinder through the one end opening, the helical spring part is contained in the hollow cylinder and urges the contact part in a direction for causing the contact part to protrude from the one end opening of the hollow cylinder, the contact part has a longitudinal shape elongated along an axis of the helical spring part, the image forming apparatus further comprises a helical spring and a power source substrate, the helical spring and the power source substrate are disposed in the apparatus main body, the helical spring is in electrically conductive communication with the helical spring part of the contact spring through a wire, and one end of the helical spring is in electrically conductive contact with the power source substrate.

* * * * *